US009392928B2

(12) United States Patent
Leone et al.

(10) Patent No.: US 9,392,928 B2
(45) Date of Patent: Jul. 19, 2016

(54) DISHWASHER APPLIANCE HAVING DISPENSER MOUNTING ASSEMBLY FOR RECEIVING CLEANING AGENT DISPENSER

(71) Applicant: General Electric Company, Schenectady, NY (US)

(72) Inventors: Davide Jonathan Leone, Louisville, KY (US); Eric Theodore Hervol, Prospect, KY (US); Matthew David Mersch, Louisville, KY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/521,652

(22) Filed: Oct. 23, 2014

(65) Prior Publication Data

US 2016/0113477 A1 Apr. 28, 2016

(51) Int. Cl.
*A47L 15/44* (2006.01)

(52) U.S. Cl.
CPC ..... *A47L 15/4445* (2013.01)

(58) Field of Classification Search
CPC ..... A47L 15/4445
See application file for complete search history.

(56) References Cited

U.S. PATENT DOCUMENTS 4,696,447 A * 9/1987 Strecker ..... A45D 20/12 248/206.3
2009/0065455 A1* 3/2009 Miller ..... A47L 15/505 211/70

FOREIGN PATENT DOCUMENTS

KR 101240874 * 2/2013

* cited by examiner

*Primary Examiner* — Michael Barr
*Assistant Examiner* — Jason Riggleman
(74) *Attorney, Agent, or Firm* — Dority & Manning, PA

(57) ABSTRACT

Dishwasher appliances configured to receive cleaning agent dispensers are provided. A dishwasher appliance includes a tub that defines a wash chamber for receipt of articles for washing, the tub comprising a plurality of sidewalls. The dishwasher appliance further includes a rack assembly arranged in the wash chamber, and a sump for collecting fluid from the wash chamber. The dishwasher appliance further includes a door movable between a closed position and an open position, the door including an inner wall further defining the wash chamber when the door is in the closed position. The dishwasher appliance further includes a dispenser mounting assembly disposed within the wash chamber, the dispenser mounting assembly configured to receive the cleaning agent dispenser.

17 Claims, 8 Drawing Sheets

DISHWASHER APPLIANCE HAVING DISPENSER MOUNTING ASSEMBLY FOR RECEIVING CLEANING AGENT DISPENSER

FIELD OF THE INVENTION

The subject matter of the present disclosure relates generally to dishwasher appliance, and more particularly to dispenser mounting assemblies utilized in dishwasher appliances for receiving cleaning agent dispensers.

BACKGROUND OF THE INVENTION

Dishwasher appliances generally include a tub that defines a wash compartment. Rack assemblies can be mounted within the wash compartment of the tub for receipt of articles for washing. In a typically known dishwasher appliance, spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment.

To facilitate cleaning of articles in a dishwasher appliance, cleaning agents are utilized. The cleaning agents generally mix with water in the wash compartment to form a fluid which is utilized to clean the articles during dishwasher appliance operation. Cleaning agents include, for example, detergents and rinse agents. In some cases, liquid cleaning agents are utilized, while in other cases, solid cleaning agents may be utilized.

Typically, cleaning agents are stored in reservoirs defined in the doors of dishwasher appliances, and are dispensed from these reservoirs during operation of the dishwasher appliance. However, such arrangement and storage of cleaning agents can be undesirable. For example, many cleaning agents, including many liquid rinse agents, include chemicals which can damage various plastic materials (such as the insulation used in appliance wiring) if contact is maintained for a significant period of time. In the case of appliance wiring insulation damage, arcing and sparking between wires can result.

To maintain the integrity of these plastic materials, solid cleaning agents contained in stand-alone cleaning agent dispensers have been utilized. The cleaning agent dispensers are placed in the dishwasher appliance, with the solid cleaning agents contained therein, for dispensing of the solid cleaning agents therefrom during dishwasher appliance operation. However, current dishwasher appliances make no provision for placement of such cleaning agent dispensers.

Accordingly, improved dishwasher appliances are desired in the art. In particular, dishwasher appliances which provide built in mounting assemblies for receipt of cleaning agent dispensers would be advantageous.

BRIEF DESCRIPTION OF THE INVENTION

In accordance with one embodiment, a dishwasher appliance configured to receive a cleaning agent dispenser is provided. The dishwasher appliance includes a tub that defines a wash chamber for receipt of articles for washing, the tub comprising a plurality of sidewalls. The dishwasher appliance further includes a rack assembly arranged in the wash chamber, and a sump for collecting fluid from the wash chamber. The dishwasher appliance further includes a door movable between a closed position and an open position, the door including an inner wall further defining the wash chamber when the door is in the closed position. The dishwasher appliance further includes a dispenser mounting assembly disposed within the wash chamber, the dispenser mounting assembly configured to receive the cleaning agent dispenser.

In accordance with another embodiment, a dishwasher appliance configured to receive a cleaning agent dispenser is provided. The dishwasher appliance includes a tub that defines a wash chamber for receipt of articles for washing, the tub comprising a plurality of sidewalls. The dishwasher appliance further includes a rack assembly arranged in the wash chamber, and a sump for collecting fluid from the wash chamber. The dishwasher appliance further includes a door movable between a closed position and an open position, the door including an inner wall further defining the wash chamber when the door is in the closed position. The dishwasher appliance further includes a dispenser mounting assembly disposed within the wash chamber. The dispenser mounting assembly includes a plurality of clips arranged in an annular array, each of the plurality of clips including a body extending from a surface of the dishwasher appliance and a tab extending generally inwardly from the body relative to the annular array. The body of each of the plurality of clips is angled inwardly relative to the annular array.

In accordance with one embodiment, a dishwasher appliance configured to receive a cleaning agent dispenser is provided. The dishwasher appliance includes a tub that defines a wash chamber for receipt of articles for washing, the tub comprising a plurality of sidewalls. The dishwasher appliance further includes a rack assembly arranged in the wash chamber, and a sump for collecting fluid from the wash chamber. The dishwasher appliance further includes a door movable between a closed position and an open position, the door including an inner wall further defining the wash chamber when the door is in the closed position. The dishwasher appliance further includes a dispenser mounting assembly disposed within the wash chamber. The dispenser mounting assembly includes a hoop defining a passage therethrough and a stem extending from the hoop, the stem mounted within the wash chamber.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
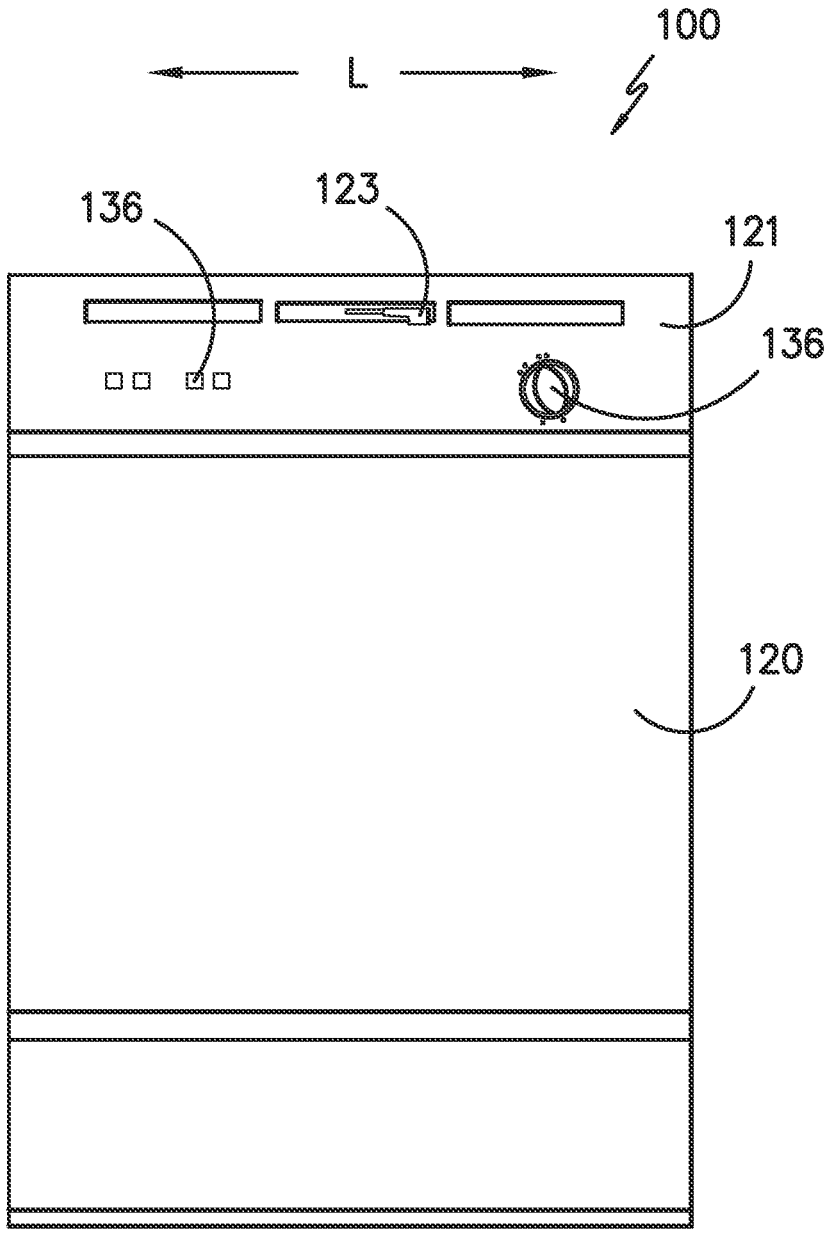
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
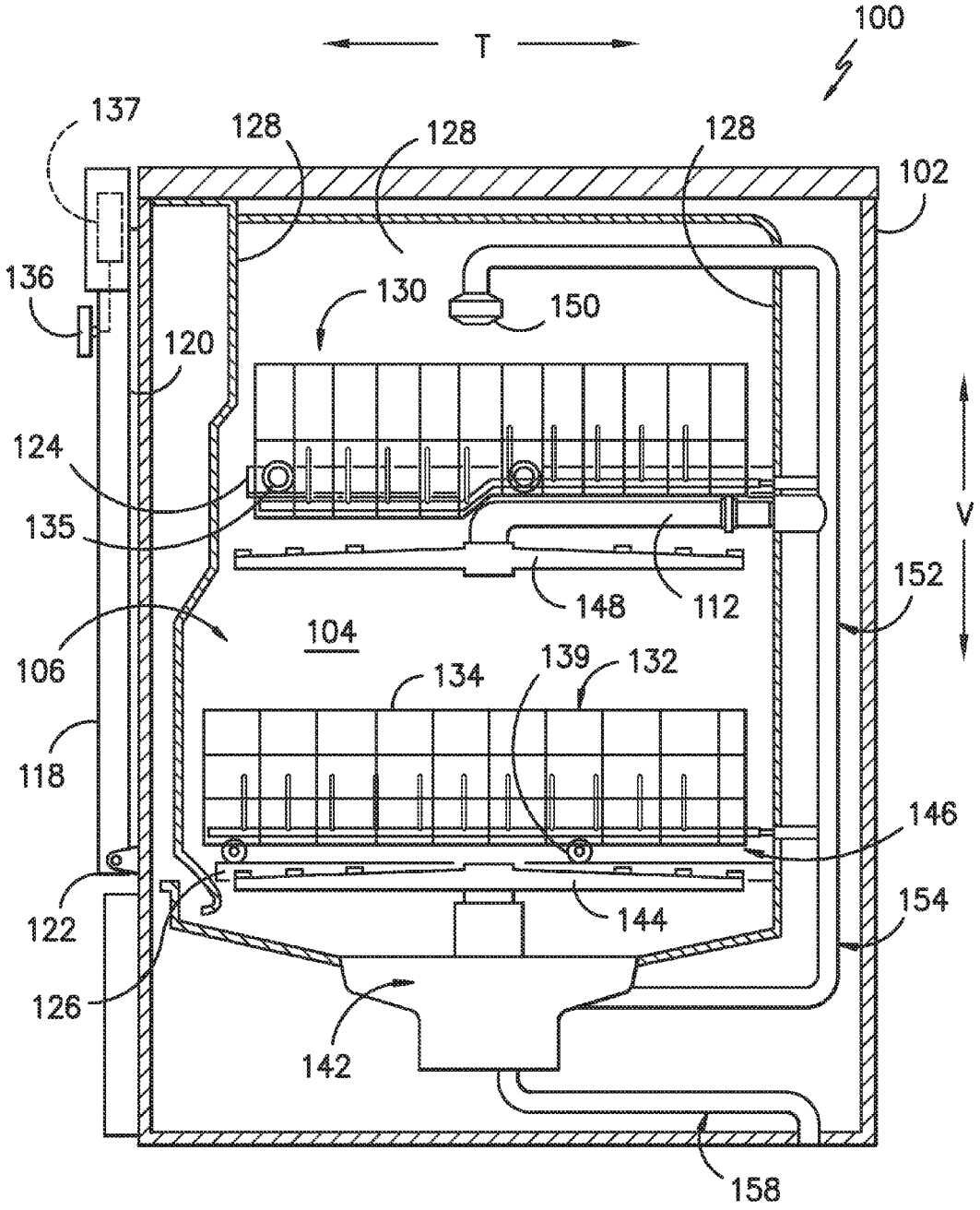
FIG. 2 provides a side, cross-sectional view of a dishwasher appliance in accordance with one embodiment of the present disclosure.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. Tub 104 includes a plurality of sidewalls 128 that define the wash chamber 106. The tub 104 further includes a front opening (not shown) and a door 118 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 118 for access to chamber 106. Door 118 includes an inner wall 120. The inner wall 120 further defines the wash chamber 106 when the door 118 is in the closed position.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack assembly 130, 132 is arranged in the wash chamber 106, such that the rack assembly 130, 132 is capable of movement between an extended loading position (not shown) in which the rack is substantially positioned outside the wash chamber 106, and a retracted position (shown in FIGS. 1 and 2) in which the rack is located inside the wash chamber 106. This is, for example, facilitated by rollers 135 and 139, for example, mounted onto rack assemblies 130 and 132, respectively. A silverware basket (not shown) may be removably attached to rack assembly 132 for placement of silverware, utensils, and the like, that are otherwise too small to be accommodated by the rack assemblies 130, 132.

The dishwasher 100 further includes a lower spray-arm assembly 144 that is rotatably mounted within a lower region 146 of the wash chamber 106 and above a sump 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray-arm assembly 144, 148 includes an arrangement of discharge ports or orifices for directing fluid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 provides coverage of dishes and other dishwasher contents with a washing spray. Other configurations of spray assemblies may be used as well.

The lower and mid-level spray-arm assemblies 144, 148 and the upper spray assembly 150 are part of a fluid circulation assembly 152 for circulating water and dishwasher fluid in the tub 104. Fluid circulation assembly 152 may further include a circulation conduit 154 which supplies the fluid to the lower and mid-level spray-arm assemblies 144, 148 and the upper spray assembly 150. The conduit 154 may, for example, be in fluid communication with the sump 142 such that fluid can flow from the sump 142 into the conduit 154 as required.

As mentioned, dishwasher assembly 100 further includes sump 142, which may be provided in lower region 146 below, for example, lower spray-arm assembly 144. Sump 142 generally collects fluid from the wash chamber 106 for circulation within the tub 104, such as back into the wash chamber 106 through fluid circulation assembly 152, as well as drainage from the tub 104 and dishwasher appliance 100 in general. Drainage may occur, for example, through a drain conduit 158 which is provided for draining fluid from the sump 142. The conduit 158 may, for example, be in fluid communication with the sump 142 such that fluid can flow from the sump 142 into the conduit 158 as required. Drain conduit 158 may flow the fluid from the sump 142 to, for example, external plumbing or another suitable drainage location.

A flood float cover 160 may be disposed within the wash chamber 106, and may generally cover a flood float (not shown). The flood float prevents excess fluid from flowing into the dishwasher appliance, as is generally understood. The flood float and cover 160 may generally be disposed in lower region 146.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 118 as shown in FIGS. 1 and 2. In such an embodiment, input/output ("I/O") signals may be routed between the control system and various operational components of dishwasher 100 along wiring harnesses that may be routed through the bottom 122 of door 118. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

As mentioned, cleaning agent dispensers 180 may be utilized in dishwasher appliances 100 in accordance with the present disclosure. A cleaning agent dispenser 180 is a standalone housing for a cleaning agent (not shown), which may be a detergent or rinse agent. Typically, the cleaning agent utilized with a cleaning agent dispenser 180 is a solid cleaning agent, such as in tablet form, as shown. The cleaning agent dispenser 180 contains the cleaning agent therein. Dispensers 180 are illustrated in FIGS. 3, 5, 6 and 8. A dispenser 180 may include a housing 184 which includes one or more sidewalls 186. Housing 184 may further include a bottom 187 and a top 188, and the sidewall(s) 186 may extend between the bottom 187 and top 188. Sidewall 186 may define a plurality of perforations 189 through which cleaning agent may be passively dispensed during operation of the dishwasher appliance 100. In exemplary embodiments, the dispenser 180 is generally conical in shape, and has a generally circular bottom 187, circular top 188, and conical sidewall 186 forming for example a truncated cone shape. The top 188 may have a greater diameter (or width) that the bottom 187 in exemplary embodiments, as shown. Alternatively, however, dispenser 180 may have any suitable shape. For example, dispenser 180 may be cylindrical or cuboid- or cubic-shaped, or may have any other suitable shape with or without a taper along the length thereof.

As further mentioned, it is desirable for dishwasher appliances 100 to provide built in mounting assemblies for receipt of cleaning agent dispensers 180. Accordingly, and referring now to FIGS. 3 through 10, the present disclosure is further directed to dispenser mounting assemblies 200. A dispenser mounting assembly 200 in accordance with the present disclosure is disposed within the wash chamber 106 of a dishwasher appliance 100, and is configured to receive a cleaning agent dispenser 180. Notably, mounting assemblies 200 are configured such that cleaning agent dispensers 180 may be received and removed as desired. Accordingly, the cleaning agent dispenser 180 can be easily removed from the mounting assembly 200 and refilled or replaced when, for example, the cleaning agent 182 in the cleaning agent dispenser 180 has been used up.

Figure 3:
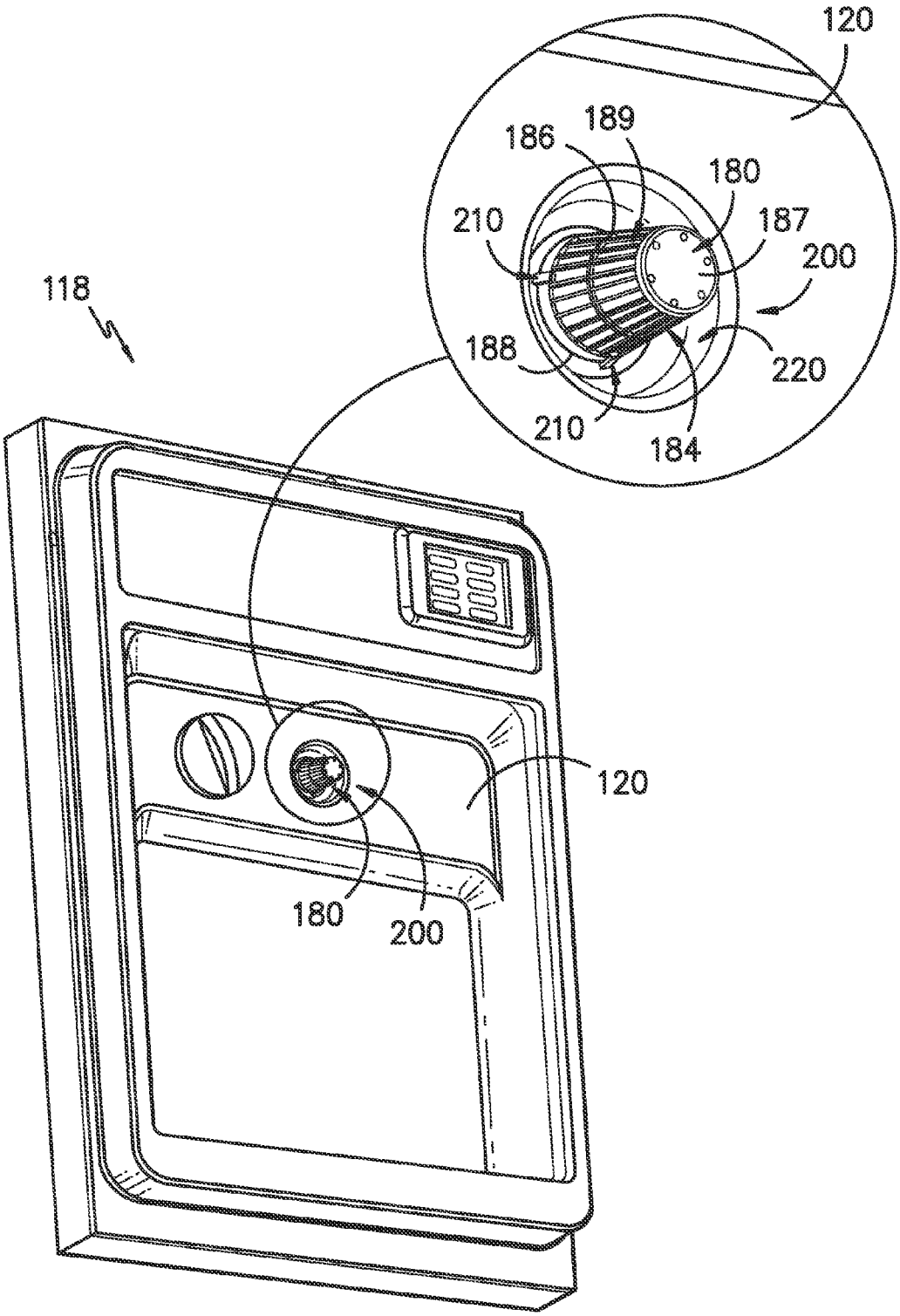
FIG. 3 provides a perspective view of a door of a dishwasher appliance with a cleaning agent dispenser received in a dispenser mounting assembly that extends from the door in accordance with one embodiment of the present disclosure.
Figure 4:
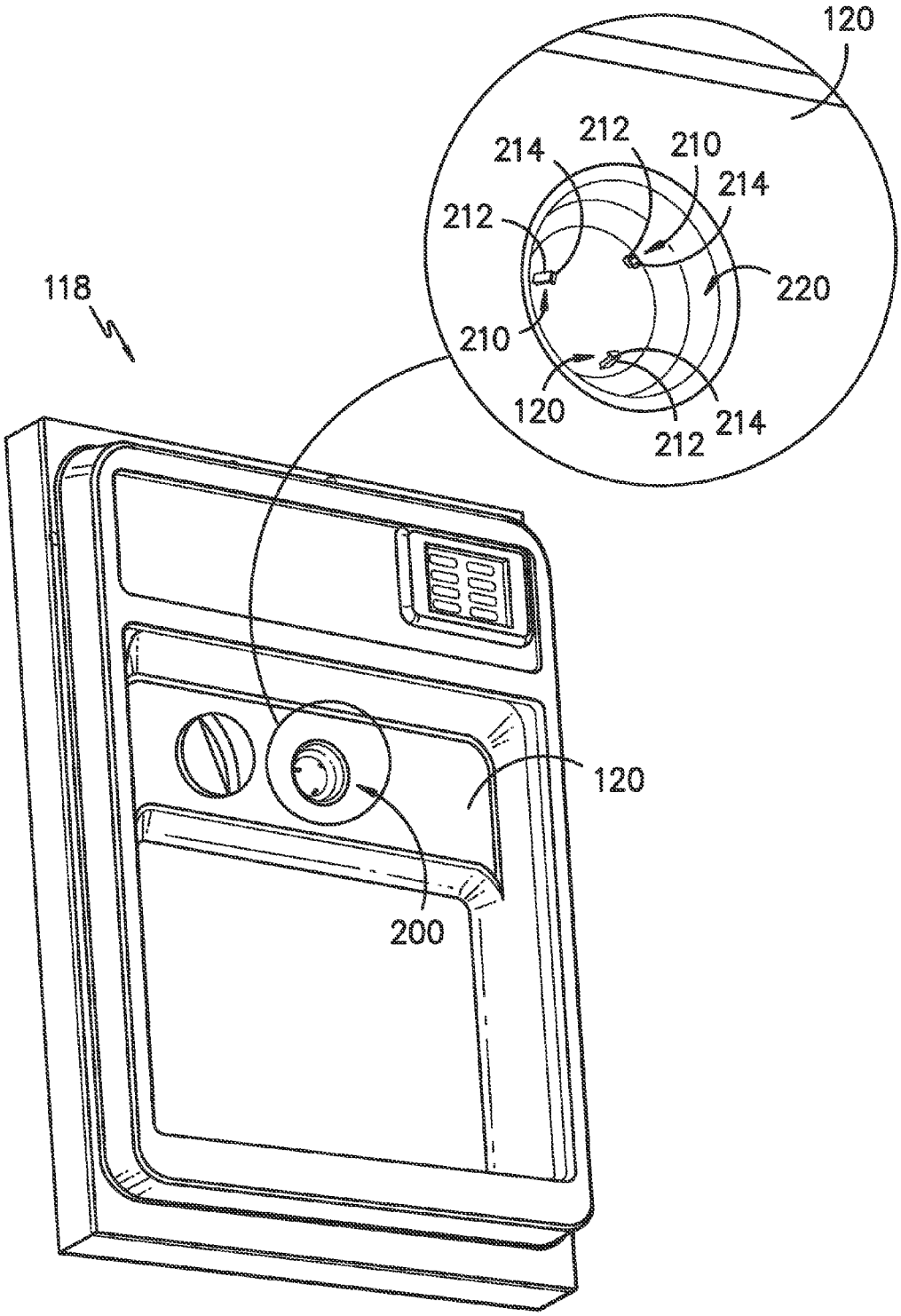
FIG. 4 provides a perspective view of a door of a dishwasher appliance with a cleaning agent dispenser removed from a dispenser mounting assembly that extends from the door in accordance with one embodiment of the present disclosure.

Referring now to FIGS. 3 and 4, in some embodiments, dispenser mounting assembly 200 may include a plurality of clips 210 which are arranged to receive a dispenser 180. The clips 210 may, for example, be arranged in a peripheral array. The size and shape of the peripheral array may, for example, correspond to the size and shape of the dispenser 180, such as the top 188 thereof. Accordingly, in exemplary embodiments, the array may be an annular array. As illustrated, when a dispenser 180 is received in a mounting assembly 200 in accordance with these embodiments, the clips 210 may generally surround the periphery of a portion of the dispenser 180 and secure the dispenser 180 within the array of clips 210.

For example, each clip 210 may include a body 212 and a tab 214. The body 212 may extend from a surface of the dishwasher appliance 100. In exemplary embodiments, as illustrated, the surface may be the inner wall 120 of the door 118. Alternatively, however, the surface may be a sidewall 128 or any other suitable surface within and/or defining wash chamber 106. Further, in exemplary embodiments, each body 212 and clip 210 in general may be integral with the surface from which the body 212 extends. Alternatively, however, the clips 210 may be separate components which are fastened to the surface from which the bodies 212 extend.

The tab 214 of each clip 210, which in exemplary embodiments is integral with the body 212 of the associated clip 210, may extend generally inwardly from the associated body 212 relative to the peripheral array. By extending inwardly, a tab 214 generally faces and extends towards other clips 210 of the array of clips 210, as illustrated. Further, in exemplary embodiments, the body 212 of each clip 210 is angled inwardly relative to the peripheral array. By being angled inwardly, a body generally extends towards other clips 210 of the array of clips 210 as it extends from the surface, as illustrated.

In exemplary embodiments as shown, a dispenser mounting assembly 200 in accordance with these embodiments may further be generally positioned within a pocket 220 that is defined in the surface from which the clips 210 extend. Pocket 220 is generally a depression defined in the surface, from which the clips 210 may extend. As shown, the body 212 of each clip 210 may extend from the surface in the pocket 220.

FIG. 3 illustrates a cleaning agent dispenser 180 received in a dispenser mounting assembly 200 in accordance with these embodiments, while FIG. 4 illustrates dispenser mounting assembly 200 with the cleaning agent dispenser 180 removed. As shown, when received in the mounting assembly 200, the dispenser 180 may be generally peripherally surrounded by the clips 210. The tabs 214 may extend into the perforations 189 to secure the dispenser 180 within the mounting assembly 200.

Referring now to FIGS. 4 through 10, in alternative embodiments, dispenser mounting assembly 200 may include a hoop 230 which defines a passage 232 therethrough. The hoop 230 may be sized and shaped to receive a dispenser 180 therein. For example, the size and shape of the passage 232 defined by the hoop 230 may correspond to the size and shape of the dispenser 180, such as the top 188 thereof. Accordingly, in exemplary embodiments, the hoop 230 has a generally circular cross-sectional shape. Alternatively, however, hoop 230 may have any suitable shape. For example, hoop 230 may have an oval, rectangular, or square cross-sectional shape, or may have any other suitable shape. As illustrated, when a dispenser 180 is receive in a mounting assembly 200 in accordance with these embodiments, a portion of the dispenser 180 may be disposed within the passage 232 and in contact with an inner surface 234 of the hoop 230, such that the hoop 230 generally surrounds the periphery of a portion of the dispenser 180 and secures the dispenser 180 therein.

In some embodiments, the inner surface 234 may include an upper portion 236, a lower portion 237 and a step portion 238 extending between the upper portion 236 and the lower portion 237. Step portion 238 may be generally transverse to the upper and lower portions 236, 237. Upper portion 236 may, for example, have a greater diameter or width than lower portion 237, and step portion 238 may bridge this size difference. Further, when a dispenser 180 is received in a mounting assembly 200 in accordance with these embodiments, a portion of the dispenser 180 may be seated on the step portion 238. Accordingly, step portion 238 may further secure the dispenser 180 within the hoop 230.

A dispenser mounting assembly 200 in accordance with these embodiments may further include a stem 240, which may extend from the associated hoop 230. Stem 240 may in exemplary embodiments be integral with the associated hoop 230. Stem 240 may be mounted within the wash chamber 106, and may thus mount the dispenser mounting assembly 200 within the wash chamber 106.

Figure 5:
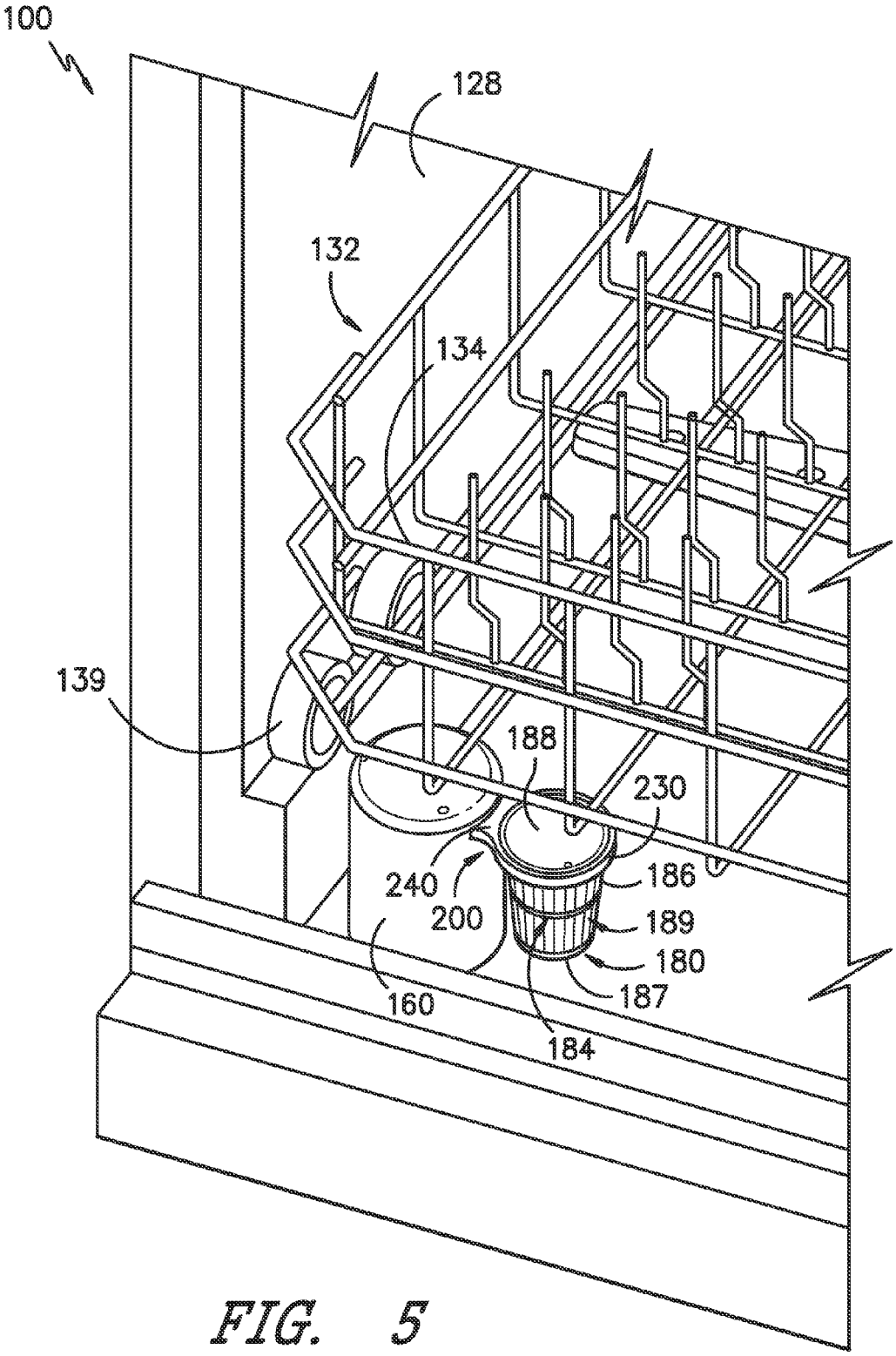
FIG. 5 provides a perspective view of a wash chamber of a dishwasher appliance with a cleaning agent dispenser received in a dispenser mounting assembly that is mounted to a flood float cover in accordance with one embodiment of the present disclosure.
Figure 10:
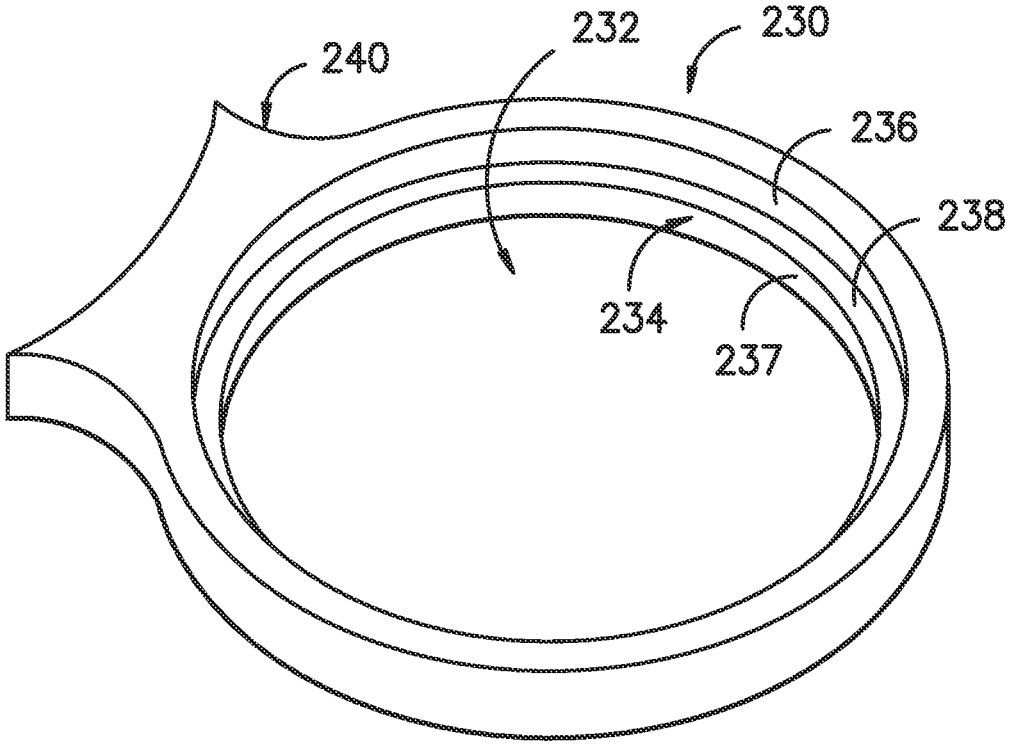
FIG. 10 provides a perspective view of a dispenser mounting assembly in accordance with one embodiment of the present disclosure.

In some embodiments, as illustrated in FIG. 5, the stem 240 is mounted to the flood float cover 160. FIG. 10 illustrates a dispenser mounting assembly 200 in accordance with these embodiments that is separate from the flood float cover 160. In these embodiments, the assembly 200 may be connected to the flood float cover 160 (or other suitable component) through use of a suitable mechanical fastener, adhesive, etc. As further illustrated in FIG. 5, however, in some embodiments the stem 240 is integrally mounted within the wash chamber 106. In these embodiments, the stem 240 may be integral with the component to which the stem 240 is mounted. As shown in FIG. 5, for example, the stem 240 and assembly 200 generally are integral with the flood float cover 160. It should be understood, however, that stem 240 and assembly 200 are not limited to integral mounting to the flood float cover 160, but rather may be integrally mounted to any suitable component within and/or defining the wash chamber 106, include sidewalls 128, inner wall 120, a rack assembly, etc.

Figure 7:
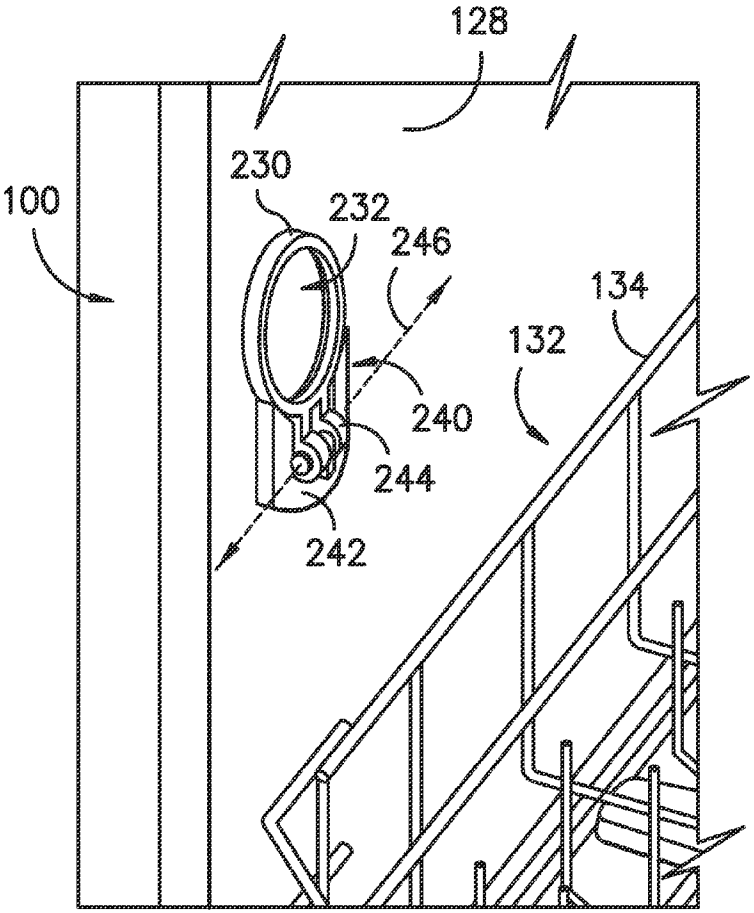
FIG. 7 provides a perspective view of a wash chamber of a dishwasher appliance with a cleaning agent dispenser removed from a dispenser mounting assembly that is mounted to a sidewall of the dishwasher appliance tub in accordance with one embodiment of the present disclosure.
Figure 6:
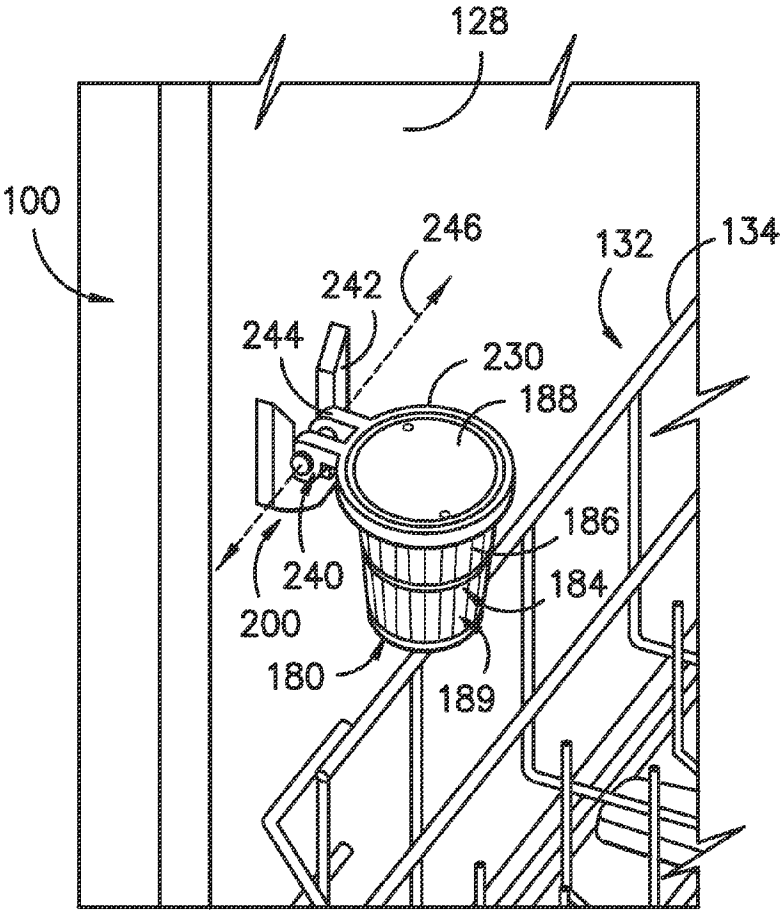
FIG. 6 provides a perspective view of a wash chamber of a dishwasher appliance with a cleaning agent dispenser received in a dispenser mounting assembly that is mounted to a sidewall of the dishwasher appliance tub in accordance with one embodiment of the present disclosure.

In other embodiments, as illustrated in FIGS. 6 and 7, the stem 240 is mounted to one of the plurality of sidewalls 128. As further illustrated, in some embodiments the stem 240 is pivotally mounted within the wash chamber 106. In these embodiments, the stem 240 may be pivotal relative to the component to which the stem 240 is mounted. For example, in these embodiments, stem 240 may include a mount portion 242 and a pivot portion 244. The mount portion 242 may mount to a suitable component within and/or defining the wash chamber 106, such as a sidewall 128. Mount portion 242 may be integral with or a separate component fastened to the suitable component. Pivot portion 244 may extend from the hoop 230, and may be pivotable about a pivot axis 246 defined at an intersection of the mount portion 242 and the pivot portion 244. FIG. 6 illustrates a cleaning agent dispenser 180 received in a dispenser mounting assembly 200 in accordance with these embodiments, with pivot portion 244 and associated hoop 230 pivoted to a receiving position. FIG. 7 illustrates dispenser mounting assembly 200 with the cleaning agent dispenser 180 removed, and with pivot portion 244 and associated hoop 230 pivoted to a storage position which is approximately 90 degrees from the receipt position. It should be understood that stem 240 and assembly 200 are not limited to pivotably mounting to a sidewall 128 or to specific pivot positions as discussed herein, but rather may be pivotally mounted to any suitable component within and/or defining the wash chamber 106, including inner wall 120, flood float cover 160, a rack assembly, etc. and pivotable to any suitable pivot positions.

Figure 9:
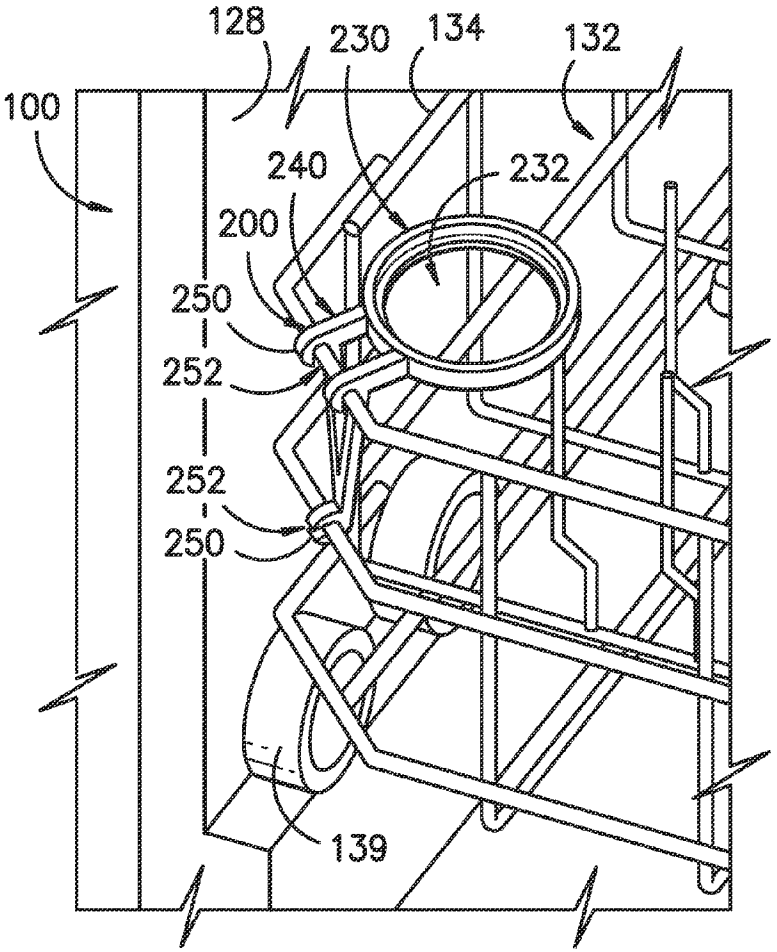
FIG. 9 provides a perspective view of a wash chamber of a dishwasher appliance with a cleaning agent dispenser removed from a dispenser mounting assembly that is mounted to a rack assembly of the dishwasher appliance tub in accordance with one embodiment of the present disclosure.
Figure 8:
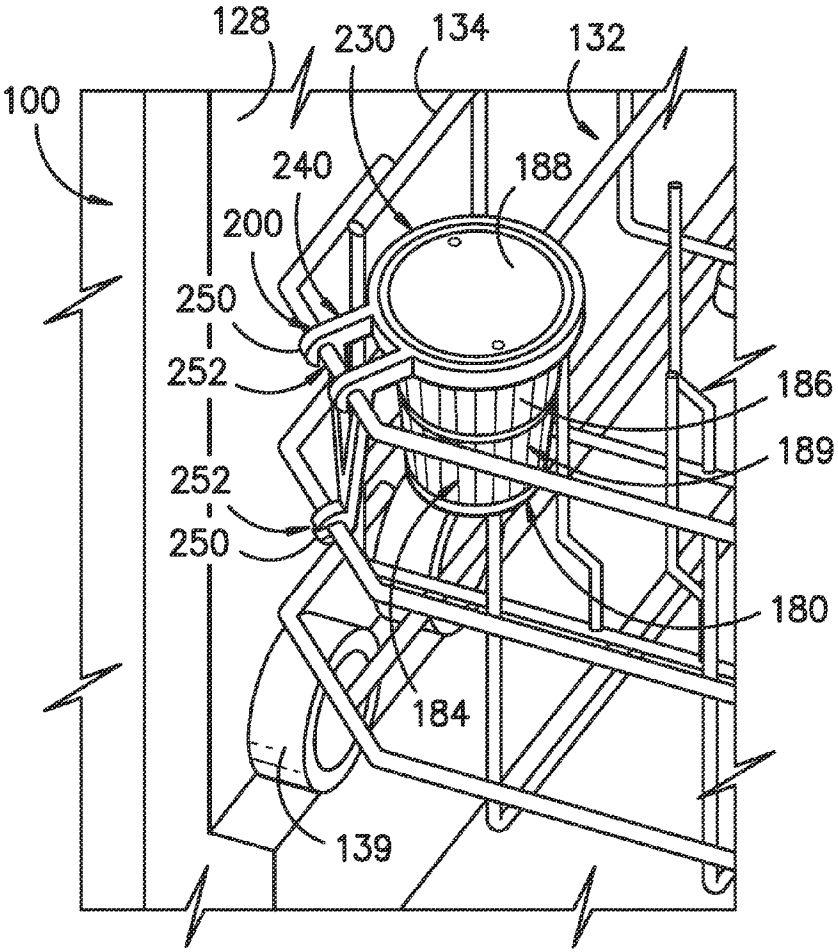
FIG. 8 provides a perspective view of a wash chamber of a dishwasher appliance with a cleaning agent dispenser received in a dispenser mounting assembly that is mounted to a rack assembly of the dishwasher appliance tub in accordance with one embodiment of the present disclosure.

In other embodiments, as illustrated in FIGS. 8 and 9, the stem 240 is mounted to a rack assembly, such as rack assembly 130 or 132. As further illustrated, in some embodiments the stem 240 is latched within the wash chamber 106. In these embodiments, the stem 240 may be latched to the component to which the stem 240 is mounted. For example, in these embodiments, stem 240 may include one or more latches 250. A latch 250, which may also be termed a hook or clip, may for example be a curvilinear portion of the stem 240, and may define a channel 252 in which a component may be disposed to latch the stem 240 thereto. In the embodiments shown, the stem 240 and assembly 200 generally are thus latched to elongated members 134 of a rack assembly, such as a rack assembly 130 or 132. Notably, such stems 240 may be easily be latched and de-latched by simply placing the components, such as the elongated members 134 within the channels 252 of the latches 250 and removing the latches 250 from contact with the components. FIG. 8 illustrates a cleaning agent dispenser 180 received in a dispenser mounting assembly 200 in accordance with these embodiments. FIG. 9 illustrates dispenser mounting assembly 200 with the cleaning agent dispenser 180 removed. It should be understood that stem 240 and assembly 200 are not limited to latching to rack assemblies as discussed herein, but rather may be latched to any suitable component within and/or defining the wash chamber 106.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance configured to receive a cleaning agent dispenser, the dishwasher appliance comprising:

a tub that defines a wash chamber for receipt of articles for washing, the tub comprising a plurality of sidewalls;

a rack assembly arranged in the wash chamber;

a sump for collecting fluid from the wash chamber;

a door movable between a closed position and an open position, the door comprising an inner wail further defining the wash chamber when the door is in the closed position; and a dispenser mounting assembly disposed within the wash chamber, the dispenser mounting assembly including a hoop having an inner surface, the inner surface have an upper portion and a lower portion, the inner surface defining a passage through the hoop, the inner surface further defining a step portion extending about the inner surface between the upper portion and the lower portion of the inner surface, the step portion being transverse to the upper and lower portion such that the step portion extends into the passage, and a stem extending from the hoop, wherein the dispenser mounting assembly is configured to receive the cleaning agent dispenser.

2. The dishwasher appliance of claim 1, wherein the stem is mounted within the wash chamber.

3. The dishwasher appliance of claim 1, wherein the stem is mounted to a flood float cover disposed within the wash chamber.

4. The dishwasher appliance of claim 1, wherein the stem is mounted to one of the plurality of sidewalls.

5. The dishwasher appliance of claim 1, wherein the stem is mounted to the rack assembly.

6. The dishwasher appliance of claim 1, wherein the stem is integrally mounted within the wash chamber.

7. The dishwasher appliance of claim 1, wherein the stem is pivotally mounted within the wash chamber.

8. The dishwasher appliance of claim 1, wherein the stem is latched within the wash chamber.

9. The dishwasher appliance of claim 1, wherein at least a portion of the cleaning agent dispenser seats on the step portion to secure the cleaning agent dispenser within the hoop.

10. The dishwasher appliance of claim 1, wherein the stem includes a mount portion and a pivot portion.

11. The dishwasher appliance of claim 10, wherein the mount portion mounts to one of the plurality of sidewalls of the tub.

12. The dishwasher appliance of claim 10, wherein the pivot portion extends from the hoop.

13. The dishwasher appliance of claim 10, wherein the pivot portion is pivotable about a pivot axis defined at an intersection of the mount portion and the pivot portion.

14. The dishwasher appliance of claim 1, wherein the stem of the dispenser mounting assembly includes at least one latch.

15. The dishwasher appliance of claim 14, wherein the rack comprises a plurality of elongated members, wherein the at least one latch defines a channel, and wherein the dispenser mounting assembly latches to the rack by placing an elongated member of the rack within the channel defined by the at least one latch.

16. The dishwasher appliance of claim 1, wherein a portion of the cleaning agent dispenser is disposed within the passage and in contact with the inner surface of the hoop when the cleaning agent dispenser is received within the dispenser mounting assembly.

17. A dishwasher appliance configured to receive a cleaning agent dispenser, the dishwasher appliance comprising:

a tub that defines a wash chamber for receipt of articles for washing, the tub comprising a plurality of sidewalls;

a rack assembly arranged in the wash chamber;

a sump for collecting fluid from the wash chamber;

a door movable between a closed position and an open position, the door comprising an inner wall further defining the wash chamber when the door is in the closed position; and a dispenser mounting assembly disposed within the wash chamber, the dispenser mounting assembly configured to receive the cleaning agent dispenser, the dispenser mounting assembly comprising a hoop defining a passage there through and a stem extending from the hoop, the stern mounted within the wash chamber, wherein the stem is mounted to a flood float cover disposed within the wash chamber.

* * * * *